United States Patent [19]

Wilson

[11] Patent Number: 5,074,511

[45] Date of Patent: Dec. 24, 1991

[54] PORTABLE KEYBOARD SUPPORT

[76] Inventor: Lonnie L. Wilson, 5444 Pine Top Cir., Raleigh, N.C. 27612

[21] Appl. No.: 664,877

[22] Filed: Mar. 5, 1991

[51] Int. Cl.[5] ..... A47B 91/00

[52] U.S. Cl. ..... 248/346; 108/28; 248/918

[58] Field of Search ..... 248/346, 176, 186, 349, 248/922, 918, 917, 127; 312/7.2, 349; 108/23, 27, 28, 33, 39, 93

[56] References Cited

U.S. PATENT DOCUMENTS

| | | | |
|---|---|---|---|
| 4,577,187 | 3/1986 | Barr | 248/346 X |
| 4,635,893 | 1/1987 | Nelson | 248/918 X |
| 4,654,762 | 3/1987 | Laverick | 108/23 |
| 4,863,124 | 9/1989 | Ball | 108/28 |
| 4,913,390 | 4/1990 | Berke | 248/918 X |
| 4,974,808 | 12/1990 | Ball | 108/93 X |

*Primary Examiner*—J. Franklin Foss

*Attorney, Agent, or Firm*—Rhodes, Coats & Bennett

[57] ABSTRACT

The present invention is a portable keyboard support for use in connection with a pre-existing work surface. The keyboard support comprises a generally flat sheet of material having a rear portion adapted to lie on top of the work surface and a forward portion adapted to extend forwardly from a front edge of the work surface in cantilever fashion. A computer and/or display rests on top of the rear portion and the weight of the computer and/or display holds the keyboard support in place. The keyboard rests on the forward portion and is preferably placed directly in front of the display. The forward portion also includes an integrally formed wing section that extends laterally from one side of the keyboard support. The wing section provides an auxiliary work surface which may be used, for instance, as a mouse pad.

11 Claims, 3 Drawing Sheets

PORTABLE KEYBOARD SUPPORT

BACKGROUND OF THE INVENTION

Keyboards and displays are frequently placed on existing office desks which are not specifically designed as computer work stations. Many office desks and work stations have a depth of only twenty-four inches. On such a work station, it is not possible to place the keyboard directly in front of the display due to the insufficient depth of the work surface. In such cases, the keyboard will generally be placed directly in front of the worker and the display unit will be placed to one side of the keyboard.

It is generally preferred that the keyboard and display be placed in the same field of vision. Also, it is preferred that frequently viewed surfaces be at or near the same optical distance. That is, the eye-to-display distance should be approximately equal to the eye-to-keyboard distance. When the display is placed to one side of the keyboard, there is no single field vision encompassing both the keyboard and display. Further, the optical distance from the operator's eyes to the display and keyboard respectfully will vary greatly. As a result, the operator's ability to maintain focus and alignment of the eyes will become greatly reduced resulting in fatigue.

Another problem associated with existing office desk and work stations relates to the absence of palm rest for keyboard operators. In order to avoid holding their arms in a suspended position for extended periods of times, some operators rest the palms of their hands on the work surface during typing. When the arms and hands are placed in an awkward position, there is a greater chance of muscular damage. For example, data indicates that wrist extension beyond 15° is associated with carpal tunnel syndrome. Proper positioning of the arms and hands is therefore necessary to avoid carpal tunnel syndrome and other repetitive motion disorders.

In recent years, great effort has been expended to design computer work stations which are suitable for computer operators. However, less attention has been given to the problem of outfitting pre-existing office desks and work stations which are not specifically designed for computer operators, but which are nevertheless used by such persons. However, several portable keyboard supports are disclosed in the patents to Godfrey et al, U.S. Pat. No. 4,511,111 and Burke, U.S. Pat. No. 4,913,390.

SUMMARY AND OBJECTS OF THE INVENTION

The present invention is a portable keyboard support which is designed for use in connection with pre-existing office desks and work stations. The portable keyboard support is formed from a single sheet of material and includes a rear portion adapted to lie on top of the work surface and a forward portion adapted to extend forwardly from the front edge of the work surface in cantilever fashion. The forward portion includes a laterally extending wing which provides an auxiliary work surface for a mouse or other input device.

The present invention also includes a number of accessory items to give the keyboard support more utility. For example, the present invention includes a document holder and a lamp which both include connectors adapted to mate with preformed openings in the portable keyboard support. The present invention may also include a turntable support for the display unit and a palm rest for use in connection with the keyboard to support the arms and hands of the operator in the proper position.

Based on the foregoing, it is the primary object of the present invention to provide a portable keyboard support for use with conventional office furniture to effectively extend the work surface so that it can accommodate the placement of the keyboard directly in front of the display.

Another object of the present invention is to provide a portable keyboard support which does not require any tools of fittings to install on a work surface and which can be easily moved from one work surface to another.

Another object of the present invention is to provide a portable keyboard support which provides a work surface for an auxiliary input device such as a mouse.

Another object of the present invention is to provide a portable keyboard support adapted for use in connection with accessories commonly used by computer operators such as document holders, lamps and turntables.

Another object of the present invention is to provide a portable keyboard support which includes a palm rest to help maintain proper positioning of the arms and hands to avoid carpal tunnel syndrome and other repetitive motion disorders.

Another object of the present invention is to provide a portable keyboard support which is simple in construction, easy to manufacture and which is inexpensive.

Other objects and advantages of the present invention will become apparent and obvious from a study of the following description and the accompanying drawings which are merely illustrative of such invention.

DETAILED DESCRIPTION OF THE INVENTION

Figure 1:
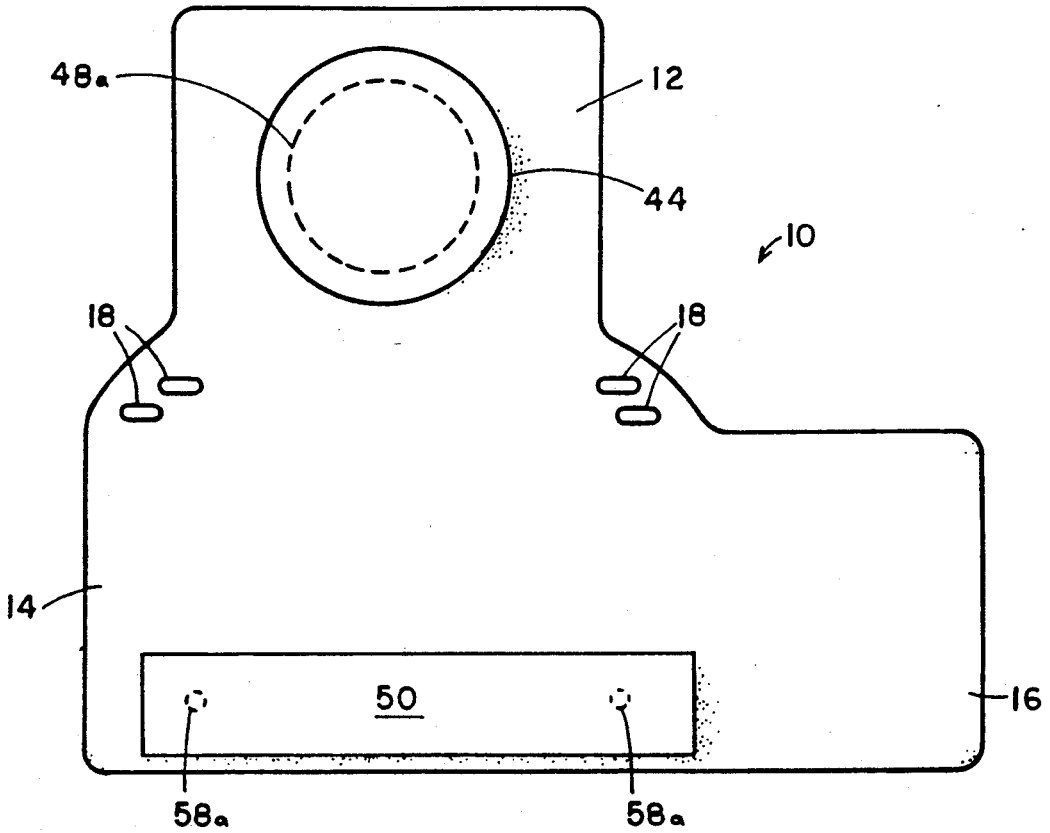
FIG. 1 is a top plan view of the portable keyboard support of the present invention.

Referring to FIG. 1, the portable keyboard support of the present invention is shown therein and indicated generally by the numeral 10. The portable keyboard support is made of a flat, sheet-like material such as plastic or acrylic. PLEXIGLASS, has been found very suitable for manufacturing the present invention due to its strength, durability and relatively light weight. Of course, other materials may be used including without limitation light weight metals (e.g. aluminum), wood and composite materials such as plywood and particle board. The portable keyboard support 10 includes a rear portion 12 and a forward portion 14 which is integrally formed with a rear portion 12. The forward portion 14 includes a laterally extending wing section 16 which extends laterally from one side of the rear portion 12. The embodiment shown in the drawings is designed for a right-handed operator and the wing portion therefore extends from the right side of the keyboard support 10.

The dimensions of the keyboard support 10 should be sufficient to accommodate a conventional display 100 and keyboard 102. The overall depth of the keyboard support is approximately twenty-six inches, with the rear portion 12 making up about half of that distance. The width of the rear portion 12 of the keyboard support 10 is approximately thirteen inches. The total width of the forward portion 14, including the wing section 16 is approximately twenty-six inches. The right edge of the wing section 16 should also be approximately twelve inches from the right edge of the rear portion 12 to provide a work surface of sufficient area for a mouse 104.

In the embodiment shown, the keyboard support 10 includes four preformed openings 18. These openings 18 are placed adjacent the junction between the rear portion 12 and forward portion 14. The openings 18 have an elongated, oval-shaped configuration and extend transversely across the keyboard support 10.

Figure 2:
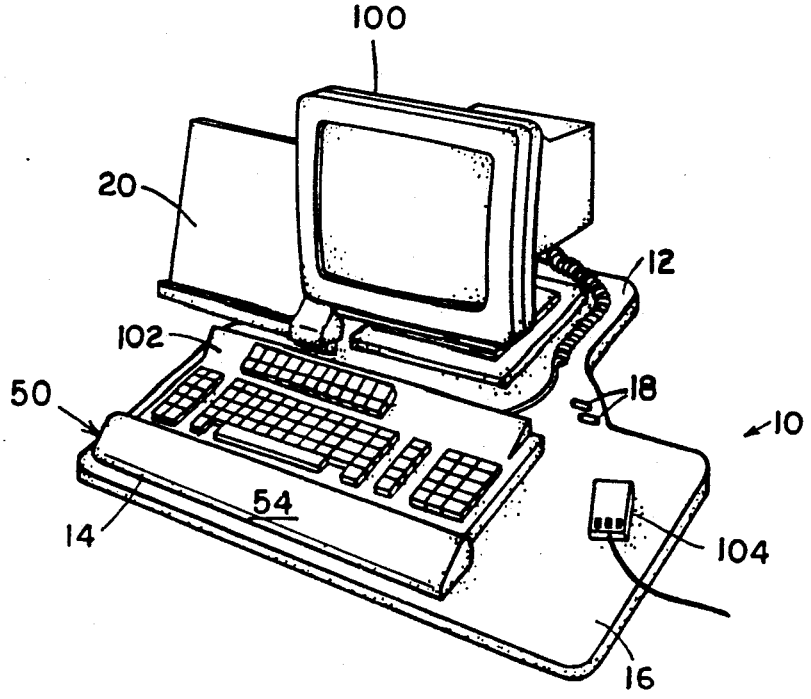
FIG. 2 is a perspective view of the portable keyboard support being used in connection with a keyboard and display terminal.

Referring now to FIG. 2, the keyboard support 10 is shown in use on a work surface indicated generally at 18. The rear portion 12 is placed on top of the work surface 18. The display 100 is placed on top of the rear portion 12 so that the weight of the display 100 holds the keyboard support 10 in place. It is understood, however, that a computer may also be placed on the rear portion 12 and the display 100 stacked on top of the computer. A keyboard 102 is placed on the forward portion 14 directly in front of the display 100. As clearly shown in FIG. 2, the keyboard 102 does not extend into the wing section 16. Thus, the wing section 16 provides an auxiliary work surface which may be used, for instance, as a mouse pad for a mouse 104.

The portable keyboard support 10 of the present invention is particularly designed for use in connection with common accessories, such as a document holder 20, a lamp, and a turntable. An optional wrist support 26 is also provided.

Figure 4:
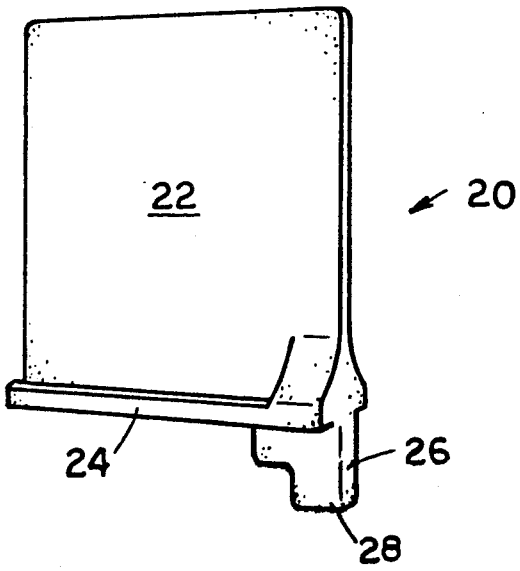
FIG. 4 is a perspective view of a document holder used in connection with the portable keyboard support.
Figure 7:
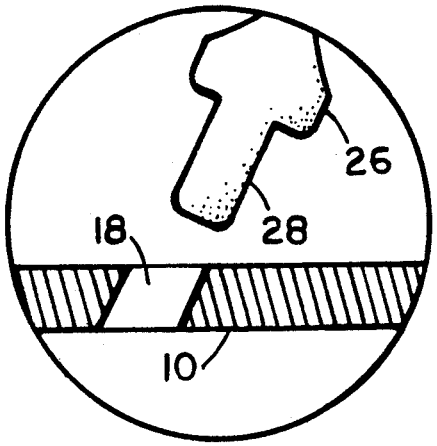
FIG. 7 is a detail section view illustrating how the document holder and lamp are mounted to the portable keyboard support.

Referring to FIG. 4, the document holder is shown. The document holder comprises a partition 22 having a flange member 24 attached to the lower edge thereof. The flange member 24 extends from the front and back side of the partition, to provide a surface for supporting documents. A connector 26 is attached to the bottom of the flange member 24 and includes a stud member 28 adapted to fit into the preformed openings 18 in the portable keyboard support 10. The stud member 28 is shaped and sized to fit snugly in the preformed openings 18 in the keyboard support 10. Because of the angle of the openings 18 in the keyboard support 10, the document holder 20 will be inclined so as to be nearly perpendicular to the operator's line of sight.

In use, the document holder 20 is inserted into one of the openings 18 in the portable keyboard support 10. Because the document holder 20 is two-sided, it can be placed on either the right hand side or left hand side of the display 100. In either case, the document holder 20 should be inserted so that it extends from the opening 18 in the keyboard support 10 away from the display 100.

Figure 5:
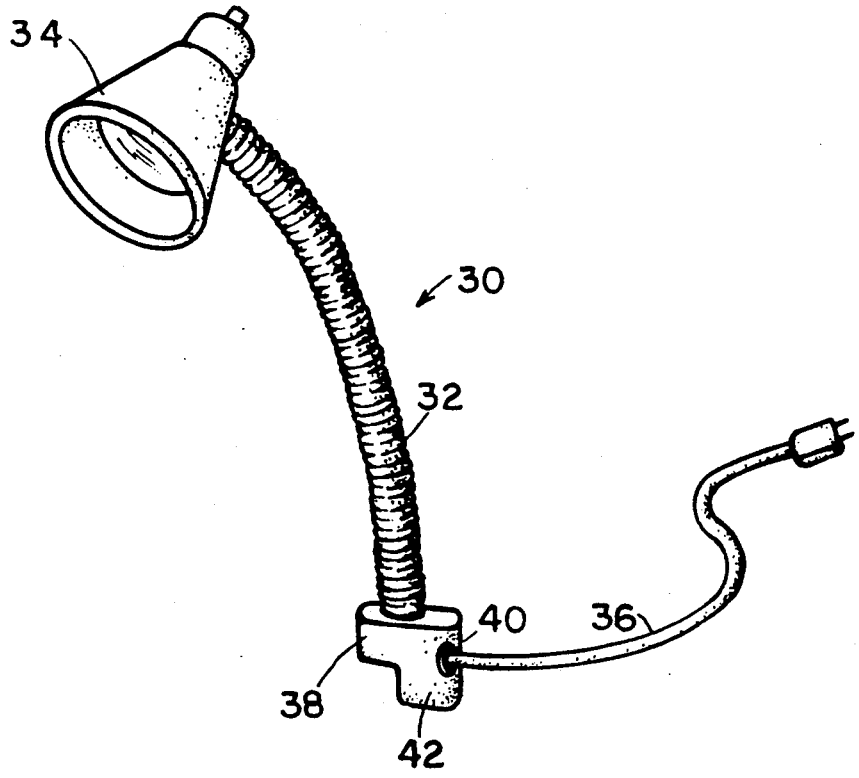
FIG. 5 is a perspective view of a lamp used in connection with the portable keyboard support.

Referring now to FIG. 5, the accessory lamp 30 is shown. The lamp includes a flexible neck 32 having a reflector 34 at one end. A lamp socket (not shown) is disposed inside the reflector 34 and the electrical cord 36 extends through the neck 32. A connector 38 is attached the lower end of the neck 32 and includes an opening 40 through which the electrical cord 36 extends. Otherwise, the connector 38 is identical to the connector 26 attached to the document holder 20. The connector 38 includes a stud member 42 adapted to snugly fit in the openings 18 in the keyboard support 10. The lamp 30 is used in the same manner as the document holder 20 by inserting the stub member 42 of the connector 38 into a selected opening 18 in the keyboard support 10 and then bending the neck 32 to direct the light in the desired direction.

Figure 3:
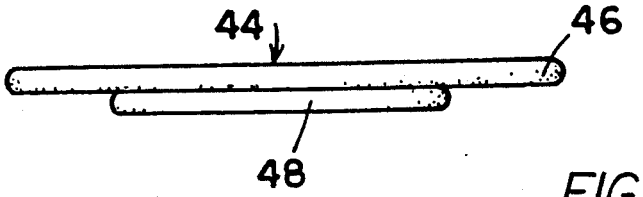
FIG. 3 is an elevation view of the turntable which forms a part of the portable keyboard support.

An optional turntable 44 adapted for use in connection with the present invention is shown in FIG. 3. The turntable 44 includes a circular top member 46 having a diameter sufficient to accommodate a display 100 and an integrally formed hub member 48 extending from the bottom side of the top member 46. A circular depression **48*a* is formed in the rear portion 12 of the portable keyboard support 10 which is only slightly larger than the hub 48 of the turntable 44. The depth of the depression 48*a* is equal to the thickness of the hub 48. Thus, the turntable 44 fits easily into the circular depression 48*a* in the rear portion 12 of the portable keyboard support 10. It is important that the downwardly facing surfaces of the turntable 44 and the surfaces of the keyboard support 10 be smooth to reduce the friction between the turntable 44 and the keyboard support 10. If a turntable 44 is used, the display unit would rest on top of the turntable 44** which would provide means for swiveling the display.

Figure 6:
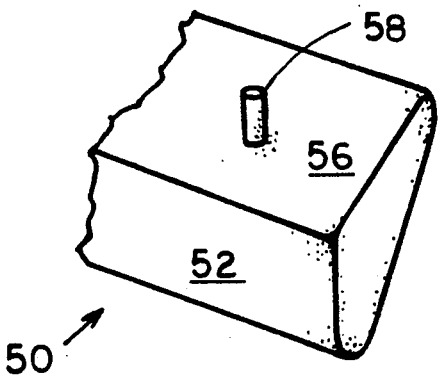
FIG. 6 is a partial perspective view of the palm rest as seen from the bottom.

FIG. 6 illustrates a palm rest 50 for use in connection with the portable keyboard support 10. The palm rest 50 is an elongated member made from a hard plastic with a generally trapezial cross-section. The back edge 52 of the palm rest is approximately equal in height to the front edge of a conventional keyboard. The top surface 54 of the palm rest is inclined slightly. The slope of the top surface 54 should not exceed approximately 10°.

The palm rest 50 is attached to the portable keyboard support by a pair of downwardly projecting compression-fit pegs 58 extending from the bottom 56 of the palm rest. The pegs 58 are located at opposite ends of the palm rest 50 and are adapted to fit into peg holes **58*a* along the front edge of the keyboard support 10 to releasably secure the palm rest 50 to the forward portion 14 of the keyboard support 10**.

The palm rest 50 serves a dual function. First, the palm rest 50 provides a stop to prevent the keyboard 102 from sliding off the front edge of the keyboard support 10. Additionally, a keyboard operator may rest the palms of his or her hands on the palm rest 50 during extended periods of typing to reduce the strain which would otherwise result from having to hold his or her arms suspended. The palm rest 50 is designed to support the arms and hands in such a manner as to reduce the wrist extension which is associated with carpal tunnel syndrome. The palm rest 50 is particularly useful for computer operators who spend a majority of their time inputting data into the computer.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A portable keyboard support for use in connection with a pre-existing work surface comprising:

(a) a generally L-shaped planar member formed from a single, flat sheet of material, said planar member having a rear portion adapted to lie on top of a work surface for supporting a computer and/or display on top of the rear portion, a forward portion adapted to extend forwardly of a front edge of the work surface in cantilever fashion for supporting a keyboard and a wing section extending laterally from the forward portion to provide an auxiliary work surface to one side of the keyboard, wherein the planar member is held in place solely by the weight of the computer and/or display on the rear portion; and (b) a palm rest attached to the forward portion of the keyboard support.

2. The portable keyboard support according to claim 1 wherein the wing section extends at a right angle relative to the rear portion.

3. The portable keyboard support according to claim 1 further including a turntable mounted to the rear portion of the keyboard support on which the display is supported, said turntable providing means for swiveling the display.

4. The portable keyboard support according to claim 1 further including a plurality of preformed openings formed adjacent the junction of the rear portion and the forward portion, and connecting means adapted to mount a device, said connecting means for mounting a device to the keyboard support, said connecting means including a connector adapted to engage with the preformed openings in the keyboard support.

5. The portable keyboard support according to claim 4 wherein the device is a document holder.

6. The portable keyboard support according to claim 4 wherein the device is a lamp.

7. A portable keyboard support for use in connection with a pre-existing work surface comprising:

(a) a generally L-shaped planar member formed from a single, flat sheet of material, said planar member having a rear portion adapted to lie on top of a work surface for supporting a computer and/or display on top of the rear portion and a forward portion adapted to extend forwardly of a front edge of the work surface in cantilever fashion for supporting a keyboard, said forward portion including a laterally extending wing section providing an auxiliary work surface to one side of the keyboard wherein the L-shaped member is held in place solely by the weight of the computer and/or display on the rear portion;

(b) a plurality of preformed openings formed in the keyboard support adjacent the junction between the rear portion and the forward portion;

(c) connecting means for mounting a device to the portable keyboard support, said connecting means including a connector adapted to engage with the preformed openings in the portable keyboard support; and (d) a palm rest attached to the formed portion of the keyboard support.

8. The portable keyboard support according to claim 7 wherein the device is a document holder.

9. The portable keyboard support according to claim 7 wherein the device is a lamp.

10. The portable keyboard support according to claim 7 further including a turntable mounted to the rear portion of the keyboard support on which the display is supported, said turntable providing means for swiveling the display.

11. A portable keyboard support for use in connection with a pre-existing work surface comprising:

(a) a generally L-shaped planar member formed from a single, flat sheet of material, said planar member having a rear portion adapted to lie on top of a work surface for supporting a computer and/or display on top of the rear portion, a forward portion adapted to extend forwardly of a front edge of the work surface in cantilever fashion for supporting a keyboard and a wing section extending laterally from the forward portion to provide an auxiliary work surface to one side of the keyboard, wherein the planar member is held in place solely by the weight of the computer and/or display on the rear portion;

(b) a plurality of preformed openings formed adjacent the junction of the rear portion and the forward portion; and (c) a lamp including a connector adapted to engage with the preformed openings in the portable keyboard support.

* * * * *